US011781563B1

(12) United States Patent
Lanphier et al.

(10) Patent No.: US 11,781,563 B1
(45) Date of Patent: Oct. 10, 2023

(54) AIR-COOLED HEAT EXCHANGER WITH X-BRACE DRIVE

(71) Applicant: Hudson Products Corporation, Ball Ground, GA (US)

(72) Inventors: Michael Lanphier, Owasso, OK (US); James Smith, Houston, TX (US); Ryan Witchey, Broken Arrow, OK (US)

(73) Assignee: Hudson Products Corporation, Ball Ground, GA (US)

( * ) Notice: Subject to any disclaimer, the term of this patent is extended or adjusted under 35 U.S.C. 154(b) by 9 days.

(21) Appl. No.: 17/896,968

(22) Filed: Aug. 26, 2022

Related U.S. Application Data

(60) Provisional application No. 63/344,254, filed on May 20, 2022.

(51) Int. Cl.
*F04D 29/58* (2006.01)
*F04D 29/60* (2006.01)

(52) U.S. Cl.
CPC ..... *F04D 29/582* (2013.01); *F04D 29/601* (2013.01); *F28F 2250/08* (2013.01); *F28F 2280/06* (2013.01)

(58) Field of Classification Search
CPC ..... F28F 2250/02; F28F 2250/08; F28F 2280/06; F04D 29/582; F04D 29/5826; F04D 29/601; F04D 29/602; F04D 29/644; F04D 29/646
See application file for complete search history.

(56) References Cited

U.S. PATENT DOCUMENTS

| | | | | |
|---|---|---|---|---|
| 3,093,189 | A * | 6/1963 | Panthofer | F28D 1/024 165/122 |
| 7,880,348 | B2 | 2/2011 | McElveen et al. | |
| 8,188,698 | B2 * | 5/2012 | Rollins | F04D 27/00 318/400.41 |
| 10,684,054 | B2 | 6/2020 | Wang | |
| 10,968,920 | B2 | 4/2021 | Chothave et al. | |
| 11,098,922 | B2 | 8/2021 | Salunkhe et al. | |
| 11,125,275 | B2 | 9/2021 | Nalamwar et al. | |
| 11,293,698 | B2 | 4/2022 | Goldsmith, Jr. et al. | |
| 2011/0303395 | A1 | 12/2011 | Mori et al. | |

FOREIGN PATENT DOCUMENTS

| | | | |
|---|---|---|---|
| CN | 212959171 | U | 4/2021 |
| EP | 3009682 | A1 | 4/2016 |
| WO | WO 2022/023285 | A1 | 2/2022 |

* cited by examiner

*Primary Examiner* — Brian O Peters
(74) *Attorney, Agent, or Firm* — Cook Alex Ltd.

(57) ABSTRACT

An air-cooled heat exchanger includes a plenum with a fan ring positioned adjacent to the plenum. Support columns support the plenum and the fan ring on a support surface. An X-brace assembly includes a motor mount with leg members extending radially from the motor mount. Each of the leg members is connected to a single corresponding one of the support columns so that the leg members extend between the motor mount and the support columns. A motor including a drive shaft is mounted to the motor mount of the X-brace assembly. A fan having fan blades is mounted to the drive shaft of the motor. The fan is positioned within the fan ring between the motor and the fan ring opening.

20 Claims, 13 Drawing Sheets

AIR-COOLED HEAT EXCHANGER WITH X-BRACE DRIVE

CLAIM OF PRIORITY

This application claims the benefit of U.S. Provisional Application No. 63/344,254, filed May 20, 2022, the contents of which are hereby incorporated by reference in their entirety.

FIELD OF THE DISCLOSURE

The present disclosure relates generally to air coolers and, more specifically, to an air cooled heat exchanger including a direct drive fan mounted with an X-brace assembly.

BACKGROUND OF THE INVENTION

Heat exchangers are widely used for cooling or heating process fluid streams using a second cooling or heating fluid stream. Air-cooled heat exchangers, as the name implies, use air as the second cooling fluid and typically employ a fan to drive the air over tube bundles through which the process fluids being cooled flow. Such heat exchangers may be of the induced draft heat exchanger type or the forced draft heat exchanger type. Induced draft heat exchangers feature tube bundle(s) located on the suction side of the fan (with the fan typically positioned above the bundle). Forced draft heat exchangers feature tube bundle(s) located on the discharge side of the fan (with the fan typically positioned below the bundle). The tube bundles are typically organized in bays with each bay containing one or more tube bundles serviced by one or more fans. Each bay also includes the structure for holding the tube bundle(s), fan(s), plenum(s) and other attendant equipment.

An example of a prior art forced draft heat exchanger bay is indicated in general at 10 in FIG. 1 and includes a fan 12 which is powered by a fan motor and drive assembly 14, which are supported by a machinery mount 15. The drive assembly 14 typically provides indirect drive of the fan by the motor via a drive belt or chain that engages and extends between sheaves or sprockets mounted to the motor drive shaft and the fan central shaft. To focus and direct air flow, a fan ring 16 circumferentially surrounds the fan. A tube bundle 22 and a plenum 24 are positioned above the fan, where the latter equalizes air pressure for more even distribution of the air flow from the fan across the tube bundle. A header 25 featuring nozzles 26 directs a process fluid stream into and out of the tube bundle so that the process fluid stream is cooled by the air flow generated by the fan. Support columns 28 support the bay in an installation.

In addition, cooling devices featuring a direct-drive fan and motor assembly mounted within the cooling device using radially extending arms or legs are disclosed in U.S. Pat. No. 10,968,920 to Cothave et al. and U.S. Pat. No. 7,880,348 to McElveen et al. Cothave et al. further shows that it is known to position such a fan assembly adjacent to a heat exchanger for induced or forced air cooling. These references, however, disclose mounting the fan and motor assembly directly to a fan deck or a shroud.

Weight reductions and strength increases in air-cooled heat exchangers are desirable to provide more secure and economical transport and reductions in material costs. Weight reductions, however, should not come at the expense of structural integrity and ideally should reduce complexity.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, an air-cooled heat exchanger includes a plenum. A fan ring is positioned adjacent to the plenum and has a fan ring opening. Support columns are configured to support the plenum and the fan ring on a support surface. An X-brace assembly includes a motor mount and a number of leg members extending radially from the motor mount with each one of the leg members connected to a single corresponding one of the support columns so that the leg members extend between the motor mount and the support columns. A motor is mounted to the motor mount of the X-brace assembly and includes a drive shaft. A fan has a number of fan blades with each of the fan blades mounted to the drive shaft of the motor so that the fan blades radially extend from the drive shaft. The fan is positioned within the fan ring between the motor and the fan ring opening.

In another aspect, an X-brace assembly for mounting a fan motor to an air-cooled heat exchanger supported by a number of support columns includes a motor mount configured to attach to and support the fan motor. Leg members extend radially from the motor mount with each one of the leg members configured to be connected to a single corresponding one of the support columns so that the leg members extend between the motor mount and the support columns.

DETAILED DESCRIPTION OF EMBODIMENTS

While the technology of the disclosure is described below in terms of a forced draft air-cooled heat exchanger, it may alternatively be employed with an induced draft air-cooled heat exchanger.

Figure 1:
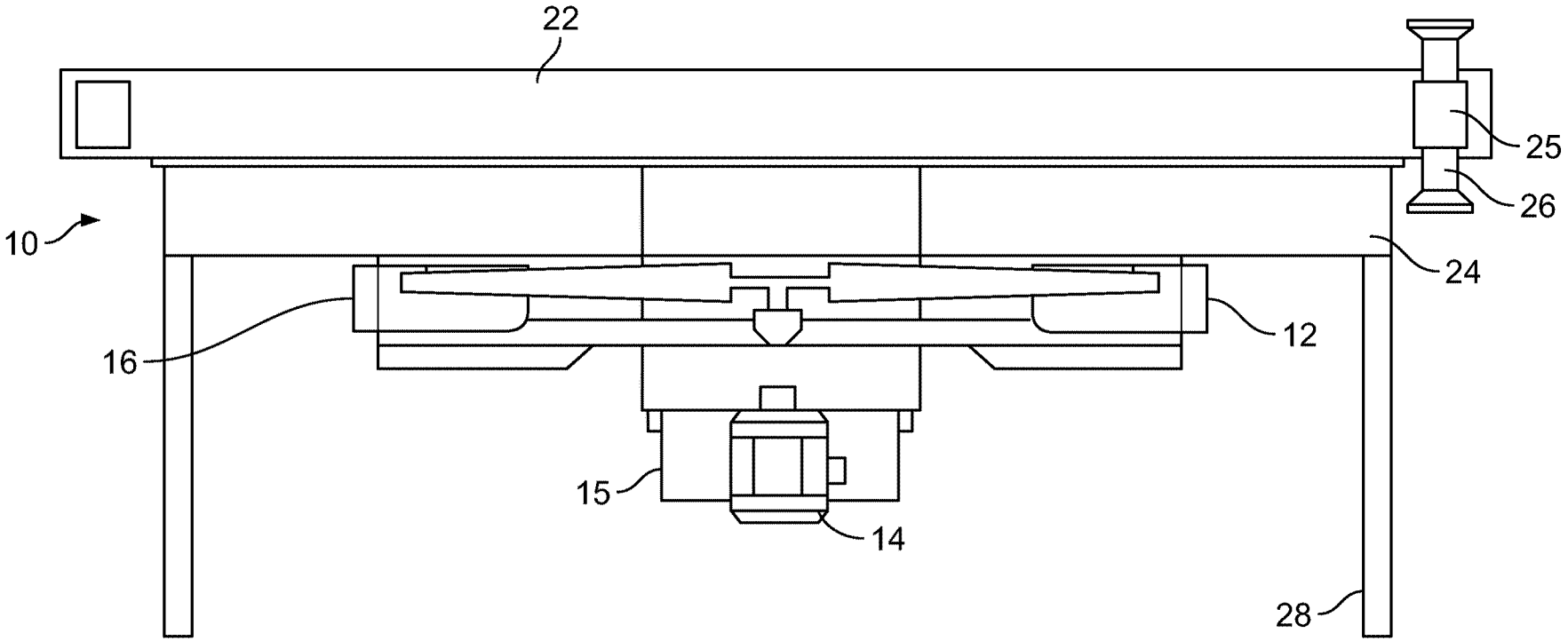
FIG. 1 (Prior Art)
FIG. 1 is a side elevational view of a prior art air-cooled heat exchanger bay.
Figure 2:
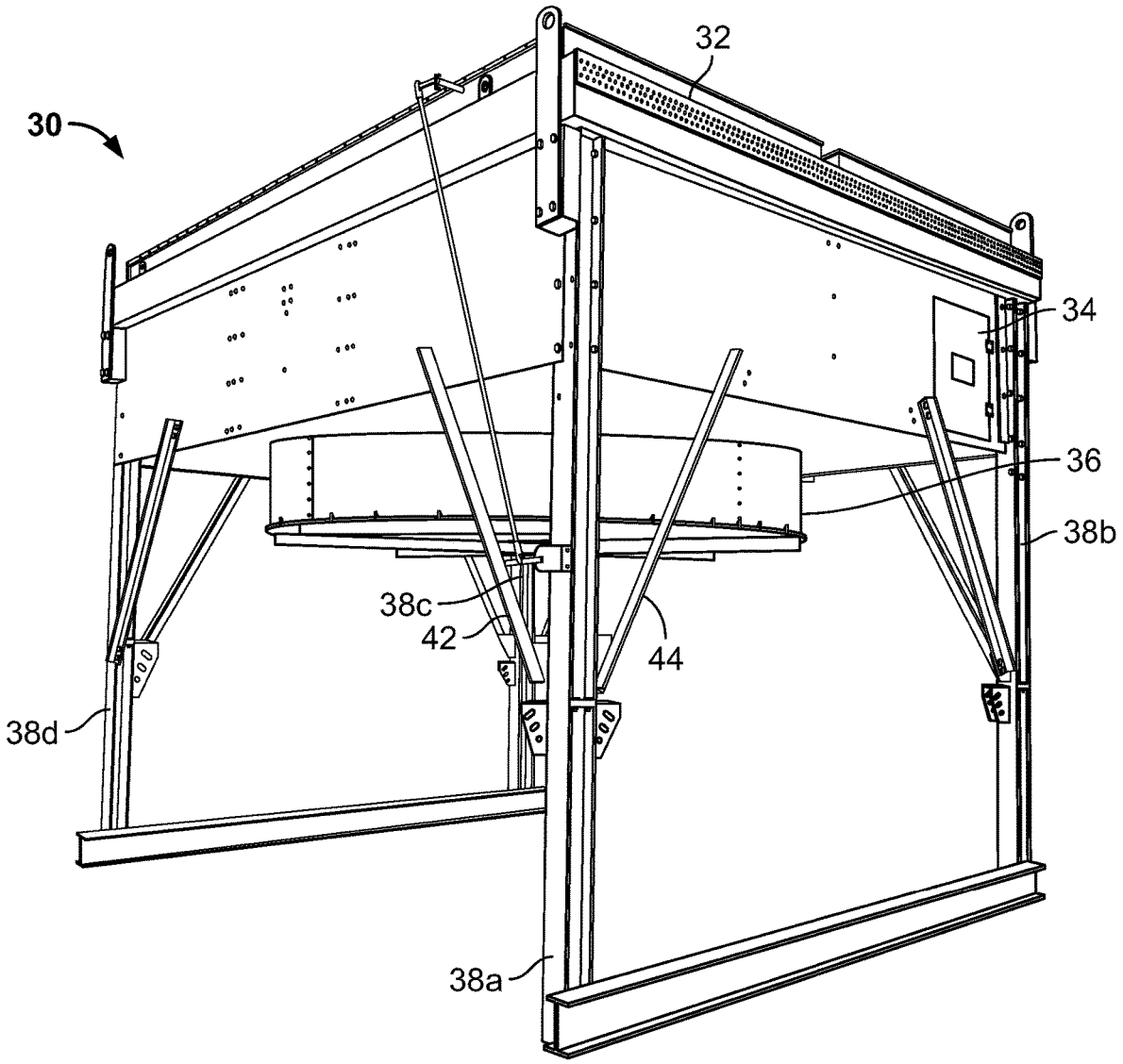
FIG. 2 is perspective view of an embodiment of the air-cooled heat exchanger of the disclosure.

An embodiment of the air-cooled heat exchanger with X-brace drive of the disclosure is indicated in general at 30 in FIG. 2. The heat exchanger includes a tube bundle 32 positioned on top of a plenum 34. A fan ring 36 is mounted to the bottom of the plenum, and features a fan ring opening that is a bottom opening, illustrated at 35 in FIG. 4, surrounded and defined by the bottom edge of the fan ring. As described in greater detail below, a fan is housed within the fan ring 36. Support columns 38*a*, 38*b*, 38*c* and 38*d* are mounted to the four corners of the plenum and tube bundle and support the heat exchanger. Each support column may be provided with a pair of struts, such as struts 42 and 44 secured to support column 38*a*.

Figure 3:
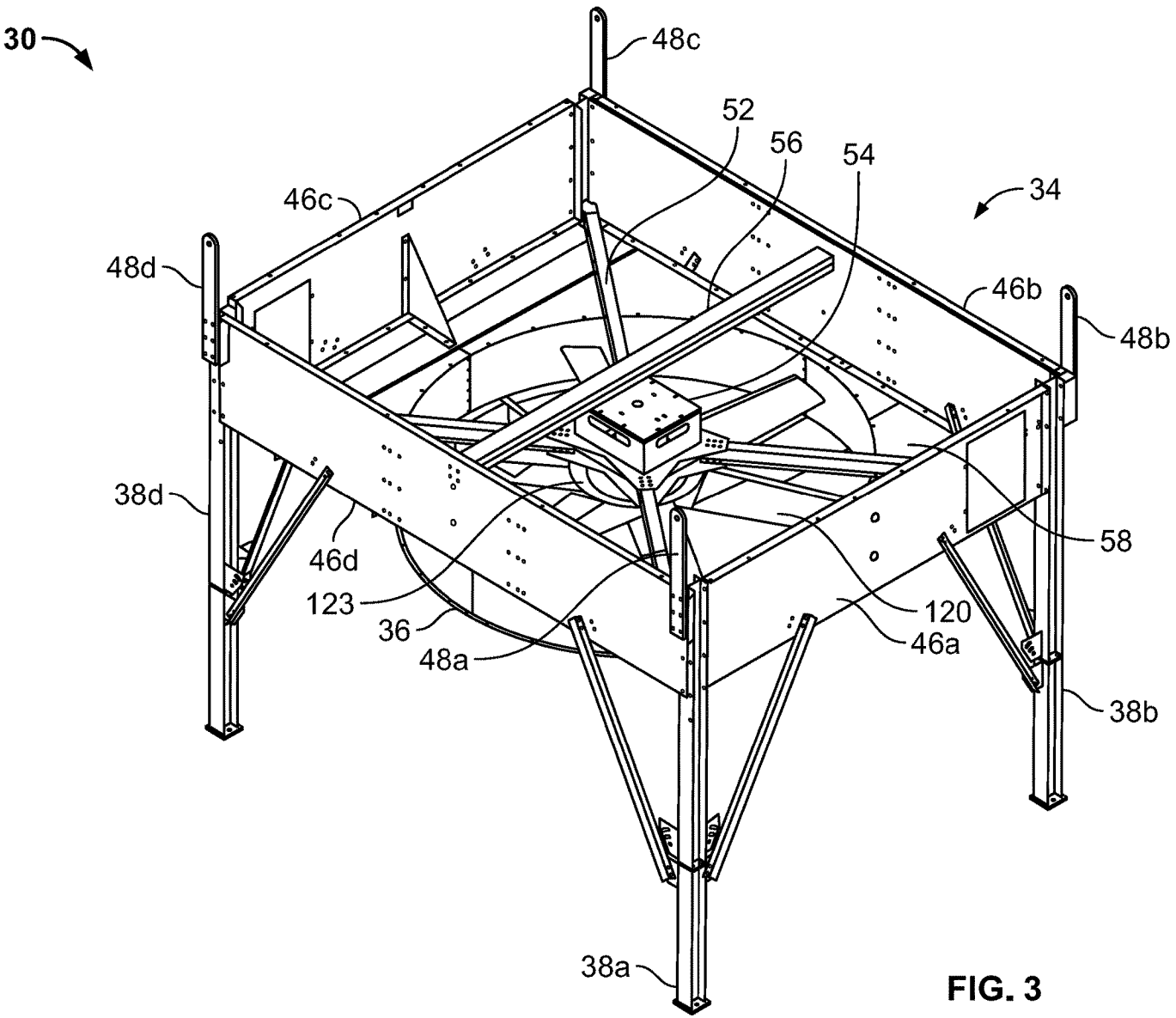
FIG. 3 is a perspective view of the air-cooled heat exchanger of FIG. 2 with the tube bundle omitted.
Figure 4:
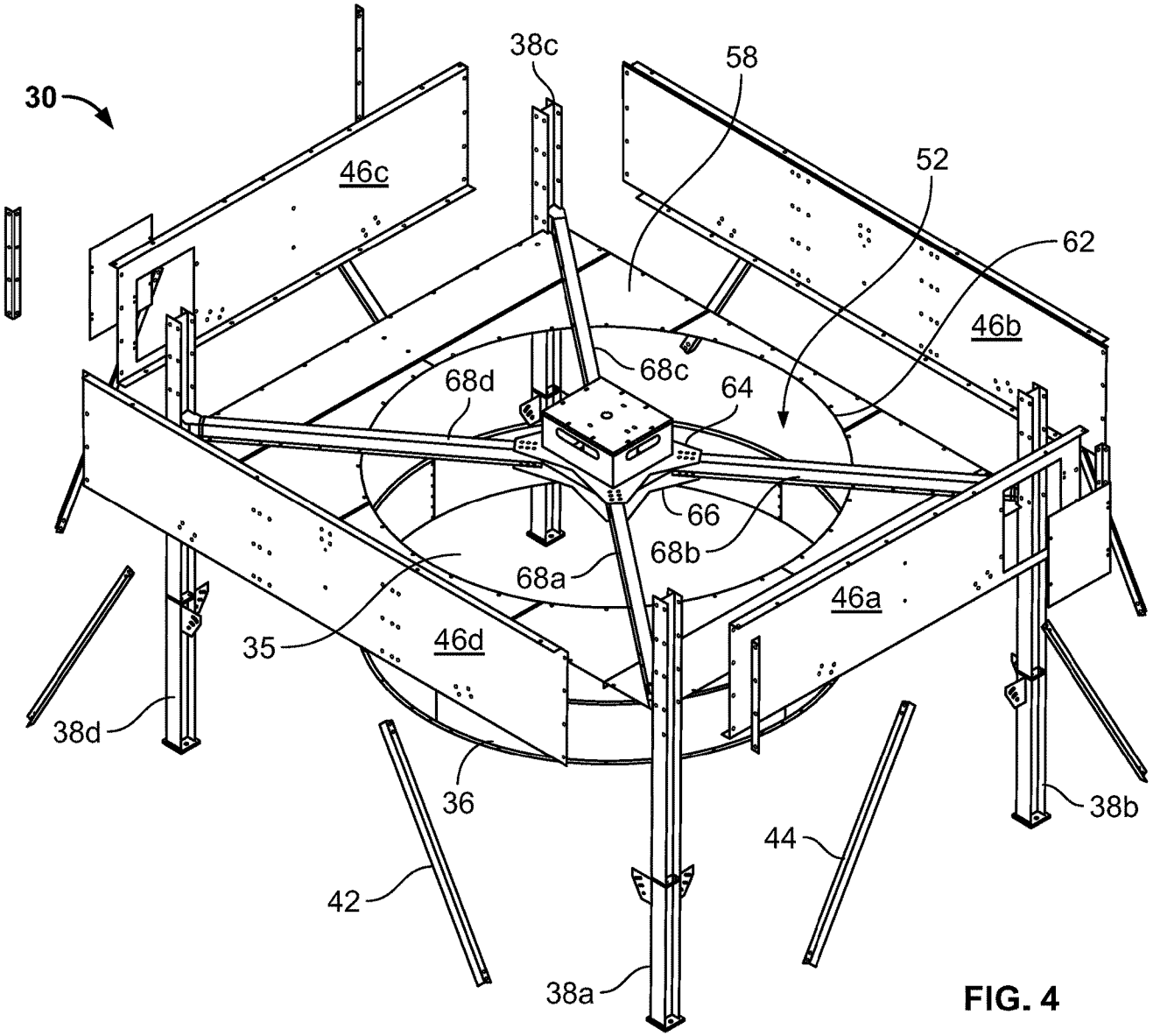
FIG. 4 is an exploded perspective view of the air-cooled heat exchanger of FIG. 3.

The heat exchanger 30 of FIG. 2 is illustrated and indicated in general at 30 in FIGS. 3 and 4 with the tube bundle removed so that the interior of the plenum, indicated in general at 34, is visible. The plenum 34 features side panels 46*a*, 46*b*, 46*c* and 46*d* extending between corresponding support columns. Tube bundle supports 48*a*, 48*b*, 48*c* and 48*d* are mounted to, and extend upwardly from, the support columns. An X-brace assembly 52 is connected to each support column 38*a*-38*d*, as described in greater detail below, and includes a centrally positioned motor mount 54. A support member 56 (FIG. 3) may extend between plenum sides 46*b* and 46*d* to add further rigidity.

As illustrated in FIG. 4, the side panels 46*a*-46*d* of the plenum may be secured to neighboring column supports 38*a*-38*d* by fasteners (where the apertures that receive the fasteners are illustrated). A plenum floor 58 is secured at its corners to support columns 38*a*-38*d* and is also fastened to the bottom edges of the plenum side panels 46*a*-46*d*. A circular central opening 62 is formed in the plenum floor 58 with the fan ring 36 circumferentially secured along or about the opening, also by fasteners. Welding or other attachment arrangements known in the art may be substituted for the fasteners noted above and below.

Figure 5:
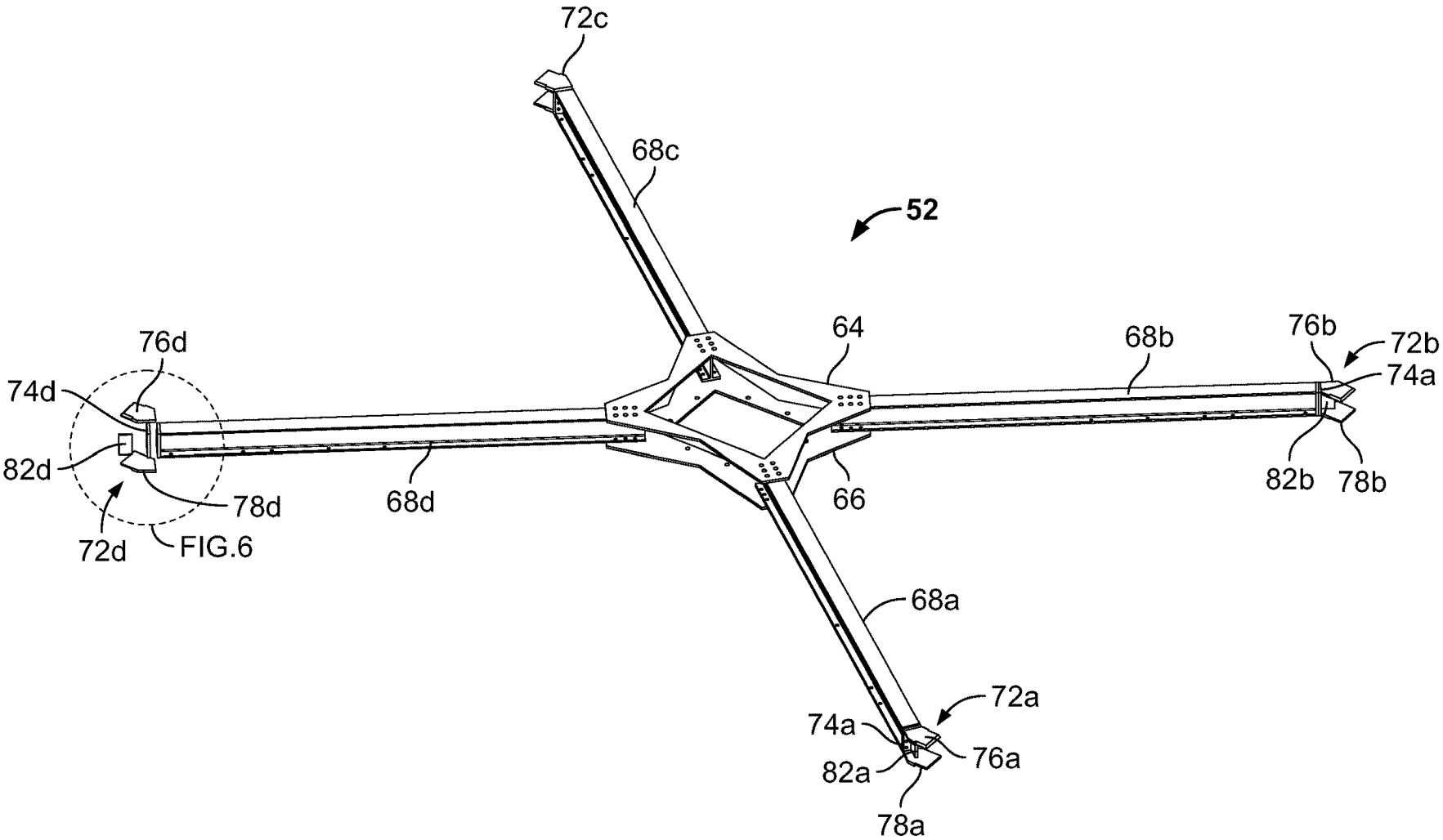
FIG. 5 is an enlarged partially exploded perspective view of the X-brace assembly of the air-cooled heat exchanger of FIGS. 3 and 4.

With reference to FIGS. 4 and 5, the X-brace assembly, indicated in general at 52, includes first and second central plates 64 and 66 which sandwich the proximal ends of four leg members 68*a*, 68*b*, 68*c* and 68*d* so that the four leg members radially extend from the central plates. As an example only, the first and second central plates 64 and 66 may be secured to the proximal ends of the four leg members by fasteners.

Figure 6:
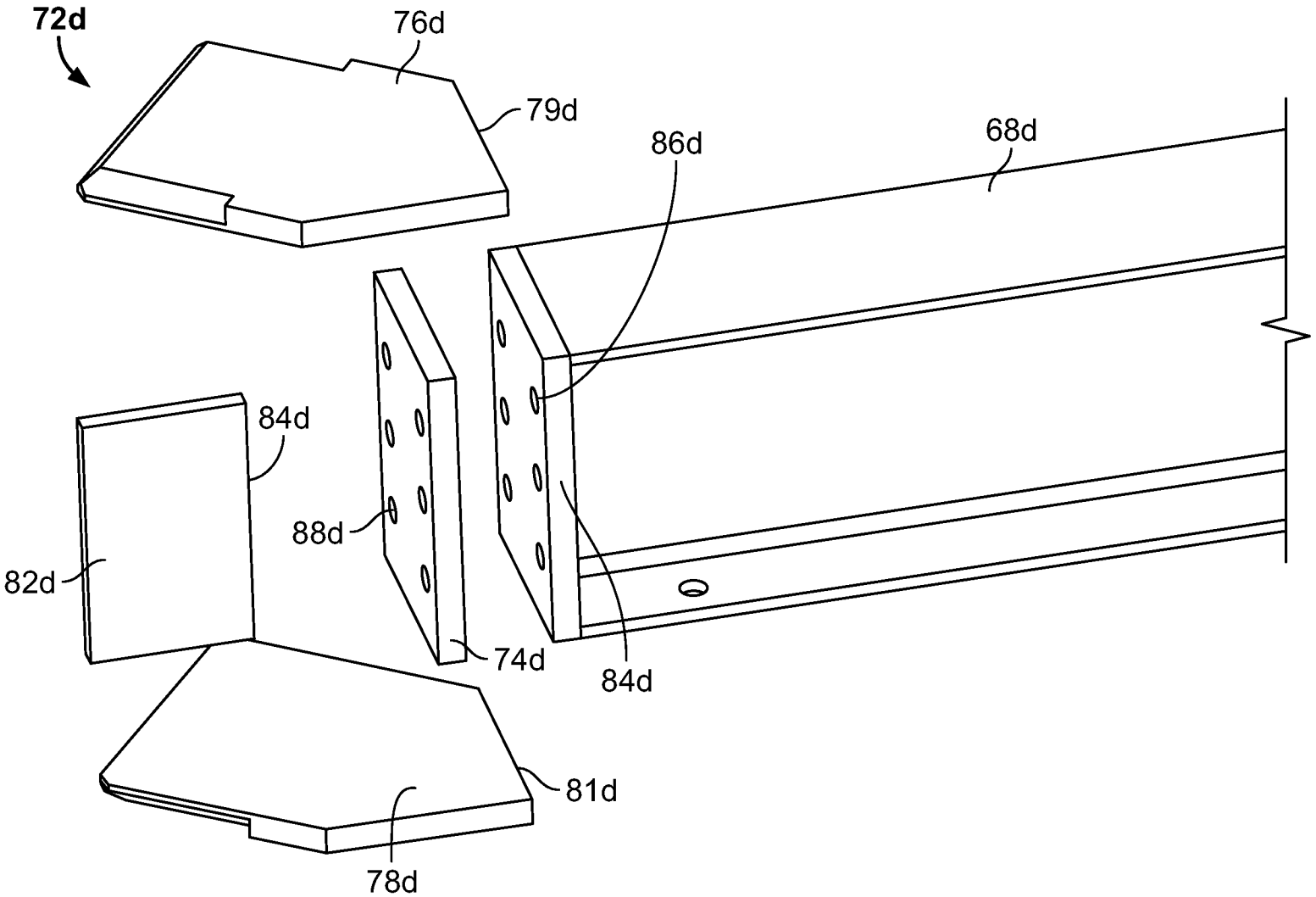
FIG. 6 is an enlarged perspective view of the exploded portion of FIG. 5.

As best shown in FIG. 5, mounting brackets 72*a*, 72*b*, 72*c* and 72*d* (where 72*a*, 72*b* and 72*d* are indicated in general) are mounted to the distal ends of each of the four leg members 68*a*, 68*b*, 68*c* and 68*d*, respectively. As illustrated in FIG. 6, where an enlarged and exploded view of mounting bracket 72*d* (indicated in general) is provided, the mounting bracket includes a bracket mounting plate 74*d* connected to upper and lower bracket plates 76*d* and 78*d*. As an example only, the top edge of the bracket mounting plate 74*d* may be welded to edge 79*d* of upper bracket plate 76*d* and the bottom edge of the bracket mounting plate may be welded to edge 81*d* of lower bracket plate 78*d*. A central support plate 82*d* is sandwiched between and welded to the parallel upper and lower bracket plates 76*d* and 78*d* by its top and bottom edges preferably in an orientation generally perpendicular to the bracket mounting plate 74*d* and the upper and lower bracket plates 76*d* and 78*d*. An inner edge 84*d* of the central support plate 82*d* also is preferably welded to the bracket mounting plate 74*d*. The assembled bracket components are illustrated for mounting brackets 72*a* and 72*b* in FIG. 5.

As illustrated in FIG. 6, a leg mounting plate 84*d*, which may be welded to the distal end of leg 68*d*, has openings 86*d* that correspond with openings 88*d* of bracket mounting plate 74*d*. As a result, fasteners, such as nuts and bolts, may be used to attach mounting bracket 72*d* to the leg mounting plate 84*d*, and thus the distal end of leg 68*d*.

As examples only, leg members 68*a*-68*d* may feature an I-beam construction and be formed from carbon steel.

Figure 7:
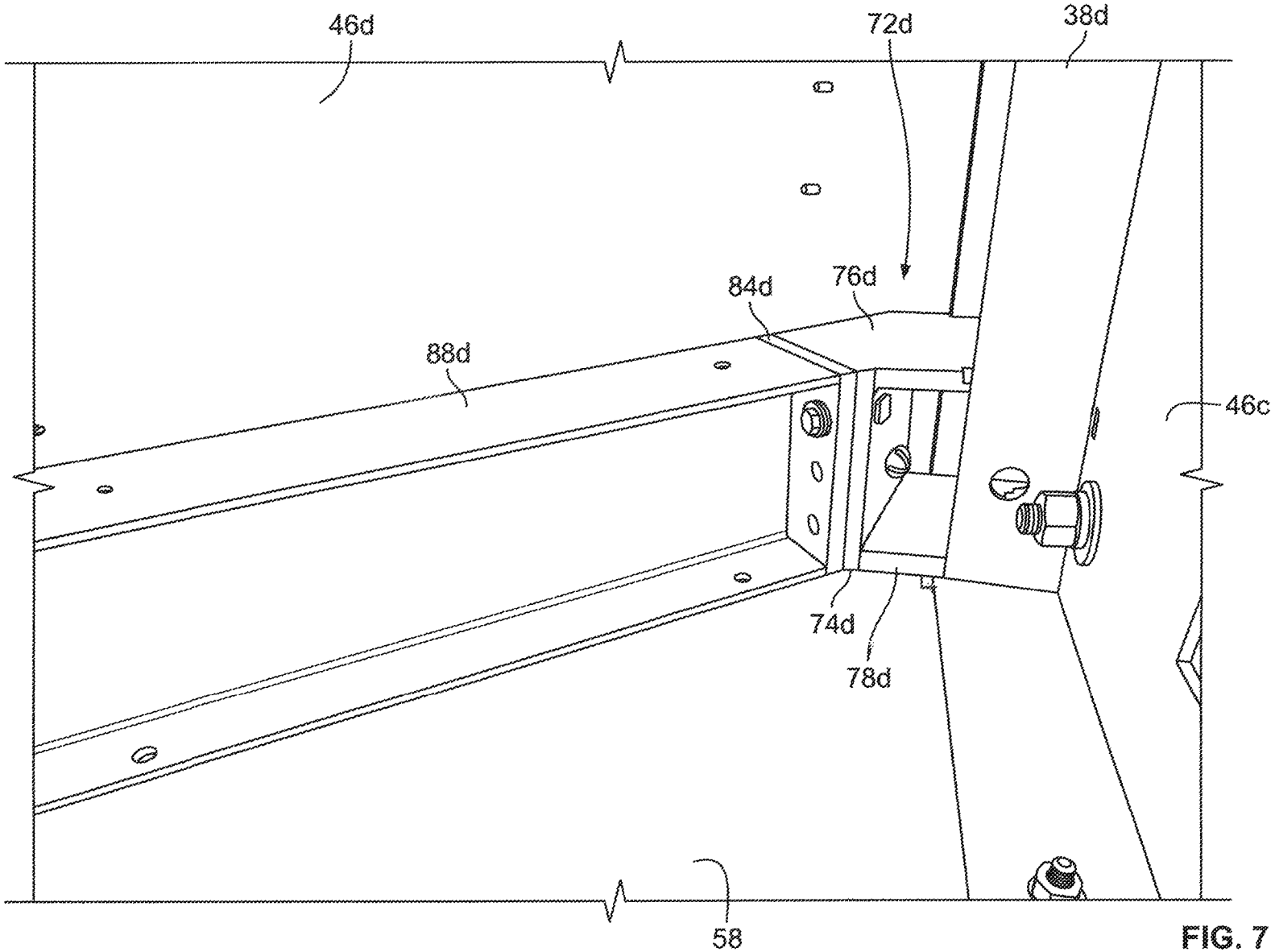
FIG. 7 is an enlarged perspective view illustrating an attachment of the distal end of a leg of the X-brace assembly by a bracket to a support column of the forced draft air cooler of FIGS. 3 and 4.

As illustrated in FIG. 7, support column 38*d* (as also illustrated in FIG. 4) features, as examples only, an I-beam construction and may be made of carbon steel (with the same construction applying to the remaining support columns). The upper and lower bracket plates 76*d* and 78*d* of the mounting bracket 72*d* are shaped so as to fit between the parallel portions or sides of the I-beam of support column 38*d* so that the mounted bracket may be welded into the position illustrated in FIGS. 7 and 4. The remaining mounting brackets 72*a*, 72*b* and 72*c* are welded to support columns 38*a*, 38*b* and 38*c*, respectively, in the same manner. As a result, the X-brace assembly 52 is directly connected to the support columns 38*a*-38*d*.

Figure 8:
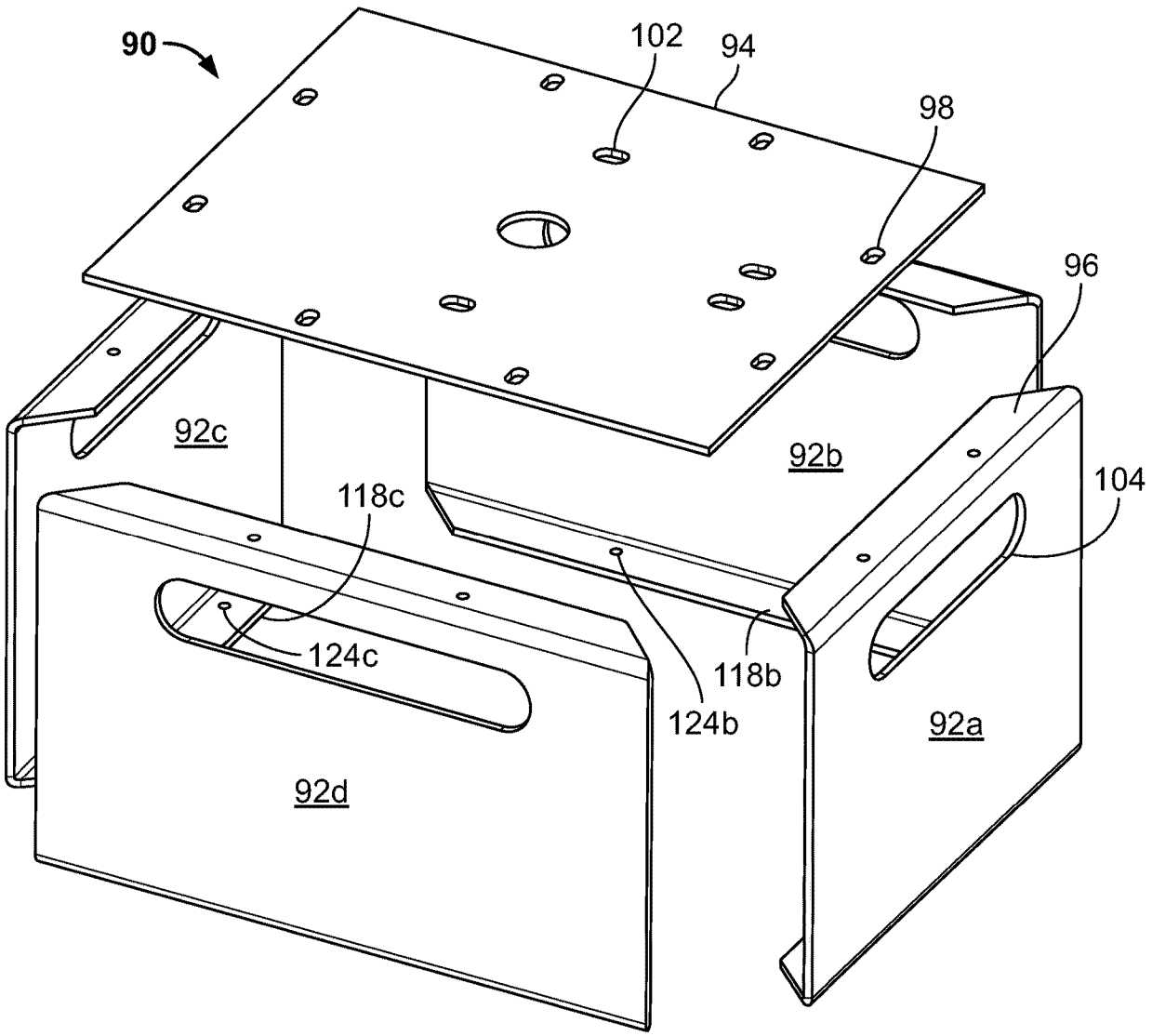
FIG. 8 is an exploded perspective view of the motor mount of FIGS. 3 and 4.

Turning to FIG. 8, an embodiment of the motor mount of the air-cooled heat exchanger with X-brace drive of the disclosure takes the form of a motor mount housing, indicated in general at 90, and includes motor mount side panels 92*a*, 92*b*, 92*c* and 92*d* as well as a motor mount plate 94. The side edges of the side panels 92*a*-92*d* may be welded together. Each of the side panels 92*a*-92*d* has an inwardly projecting upper flange at the top edge, as indicated at 96 for panel 92*a*. The motor mount plate 94 features peripheral openings 98 that align with corresponding openings of the flanges of the motor mount side panels 92*a*-92*d* so that the motor mount plate may be attached to the side panels by fasteners, such as nuts and bolts 99 and 101 illustrated in FIG. 9, so that a motor mount box or housing is formed. The motor mount plate 94 further includes motor mount apertures 102 whereby a fan motor may be mounted to the motor mount plate. Slots, such as slot 104 illustrated for side panel 92*a*, are provided in each motor mount side panel to provide cooling for a motor positioned within the motor mount as well as access for power cables.

Figure 9:
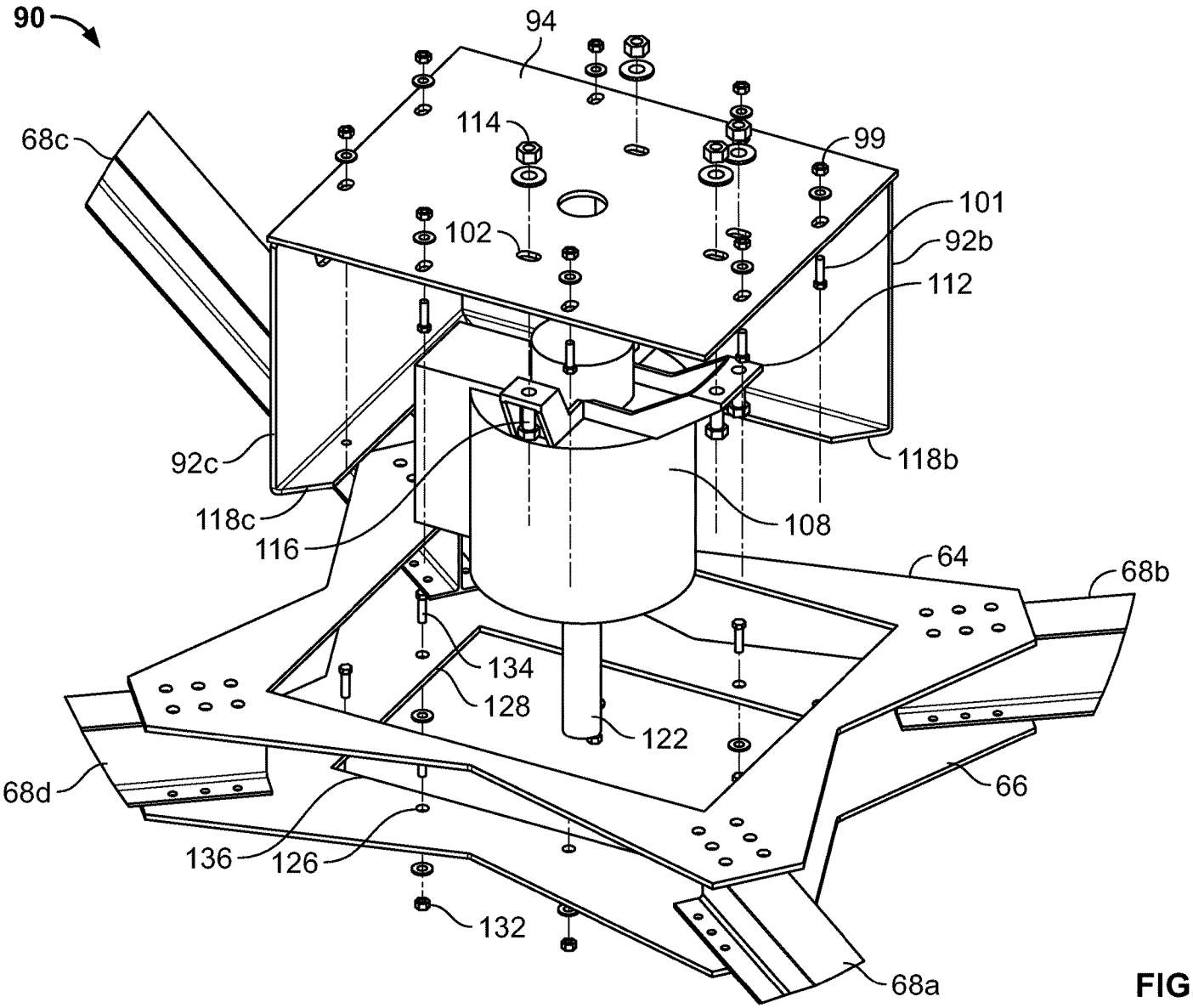
FIG. 9 is an enlarged perspective view of the motor mount and X-brace assembly of FIG. 9 including a view of the motor mount with two adjacent side panels omitted illustrating installation of the motor into the motor mount and installation of the motor mount into the X-brace assembly.

As illustrated in FIG. 9, an electric fan motor 108 is mounted via motor brackets 112 and fasteners, such as nuts and bolts 114 and 116, to the motor mount plate 94, where the nuts and bolts engage the motor mount apertures 102.

Figure 10:
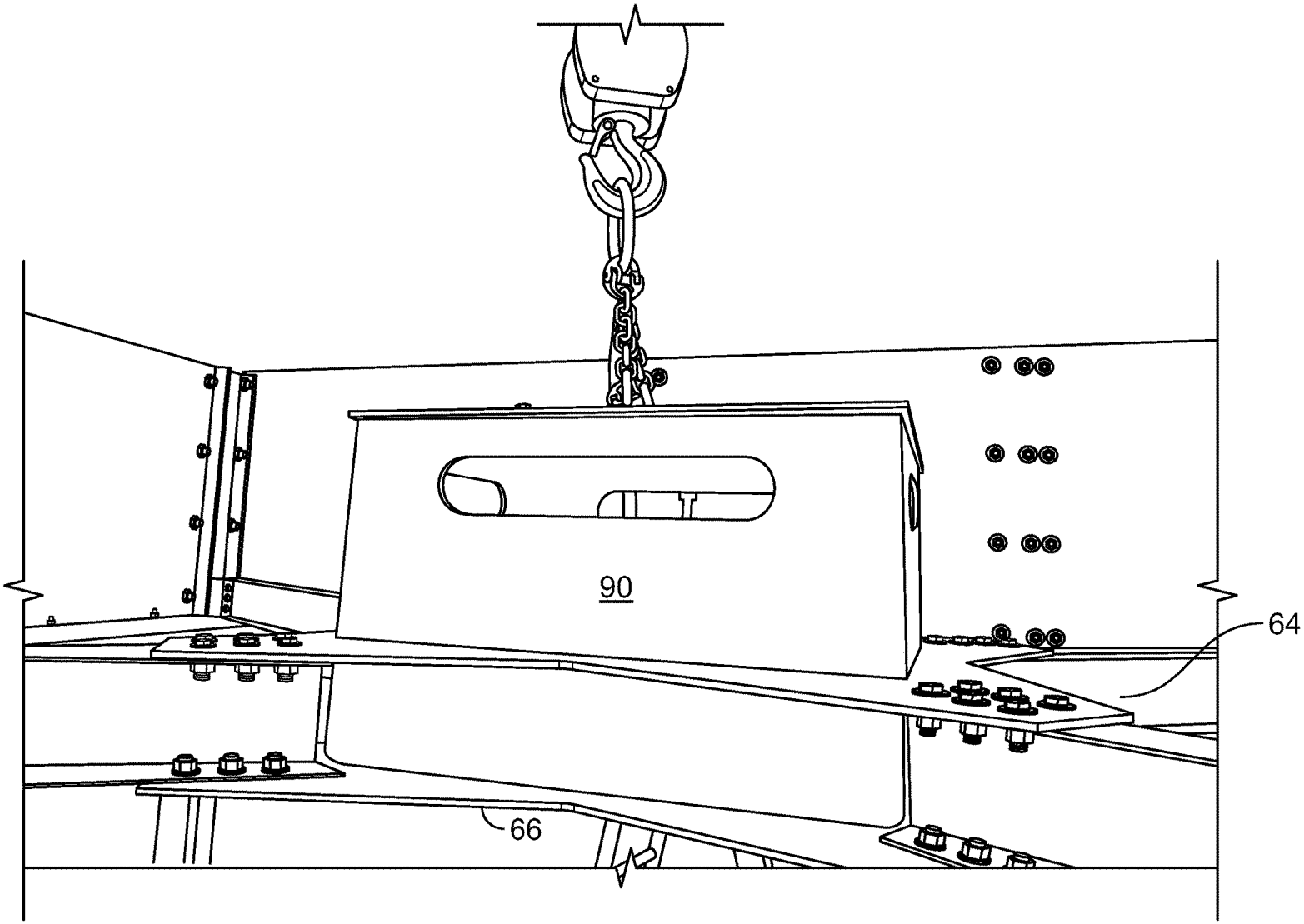
FIG. 10 is a side perspective view of the motor mount of FIGS. 3, 4 and 9 mounted within the X-brace assembly.

As illustrated in FIGS. 8 and 9 for motor mount side panels 92*b* and 92*c*, each motor mount side panel has an inwardly projecting lower flange 118*b* and 118*c* at the bottom edge. As illustrated for lower flanges 118*b* and 118*c* in FIG. 8, each lower flange is provided with apertures 124*b* and 124*c* with align with corresponding apertures, such as aperture 126 of FIG. 9, formed in the second central plate 66. As a result, as illustrated in FIGS. 9 and 10, the motor mount housing 90 may be secured within an opening 128 formed in the first central plate 64 by fasteners, such as nuts and bolts 132 and 134 (FIG. 9).

Figure 11:
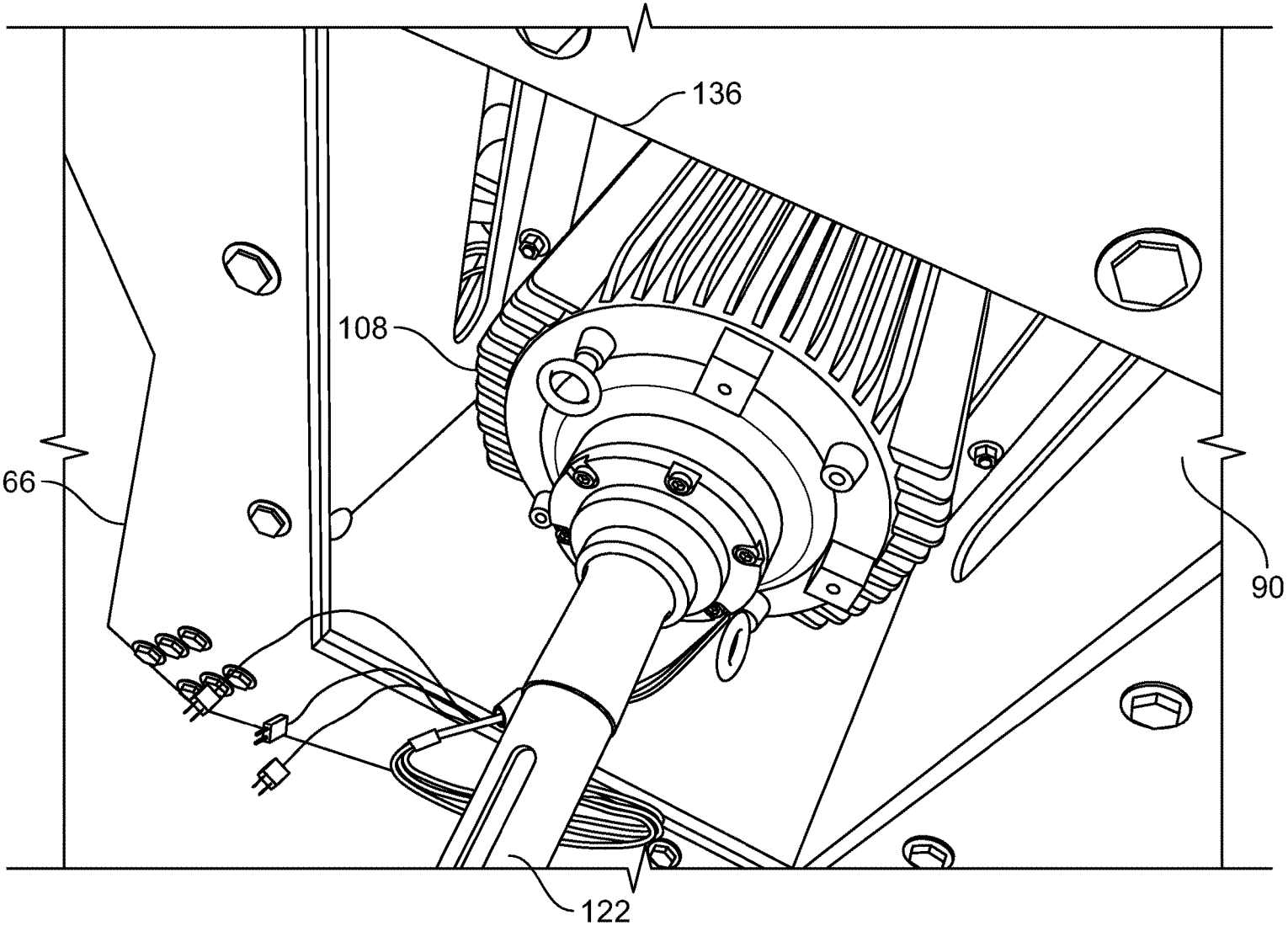
FIG. 11 is a bottom perspective view of the motor mounted within the motor mount of FIGS. 3, 4, 9 and 10.

With reference to FIG. 11, when the fan motor 108 is mounted within the motor mount housing 90, and the motor mount housing 90 is mounted to the second central plate 66 (of the X-brace assembly 52 of FIG. 5), the open bottom of the motor mount housing 90 is aligned with an opening 136 (FIGS. 9 and 11) formed in second central plate 66. As illustrated in FIG. 3, fan blades 120 are attached to the drive shaft 122 (FIGS. 9 and 11) of the fan motor by their proximal ends via a hub 123 so that they extend from the hub in a radial fashion. As a result, as illustrated in FIG. 3, the fan motor is mounted within the plenum 34 above the fan and fan ring 36.

Fan motor 108 is preferably a high efficiency transverse flux motor so that sufficient horsepower is provided to turn the large fan blades (120 of FIG. 3) while also providing a reduced motor weight. Such fan blades, as an example only, may provide the fan with a blade tip to blade tip diameter of five feet or more. As an example only, a suitable fan motor is illustrated in U.S. Pat. No. 9,618,003 to Janecek et al., the contents of which are hereby incorporated by reference.

Figure 12:
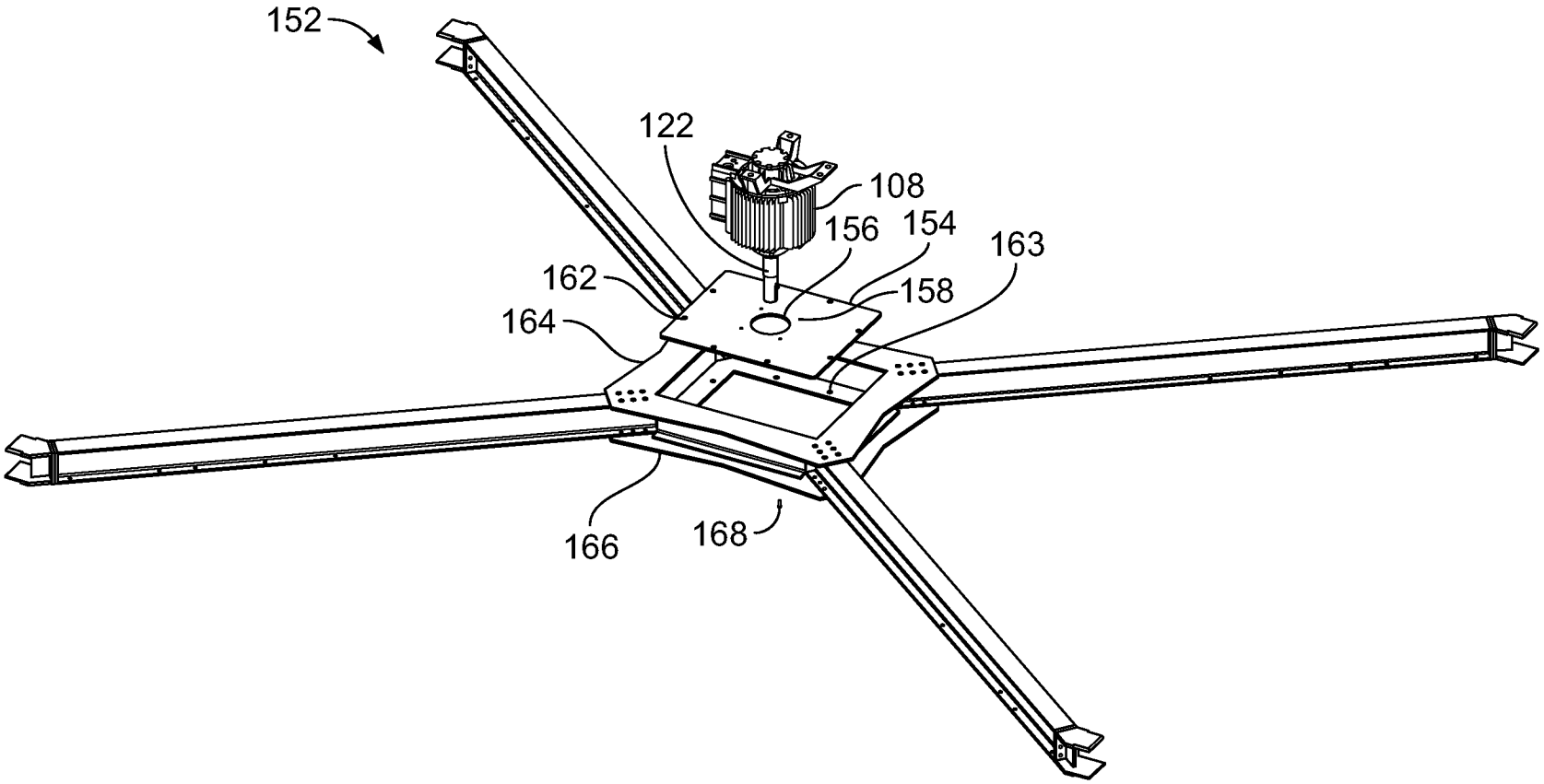
FIG. 12 is a perspective view of the X-brace assembly of FIG. 5 and an exploded view of an alternative embodiment of the motor mount and the motor.
Figure 13:
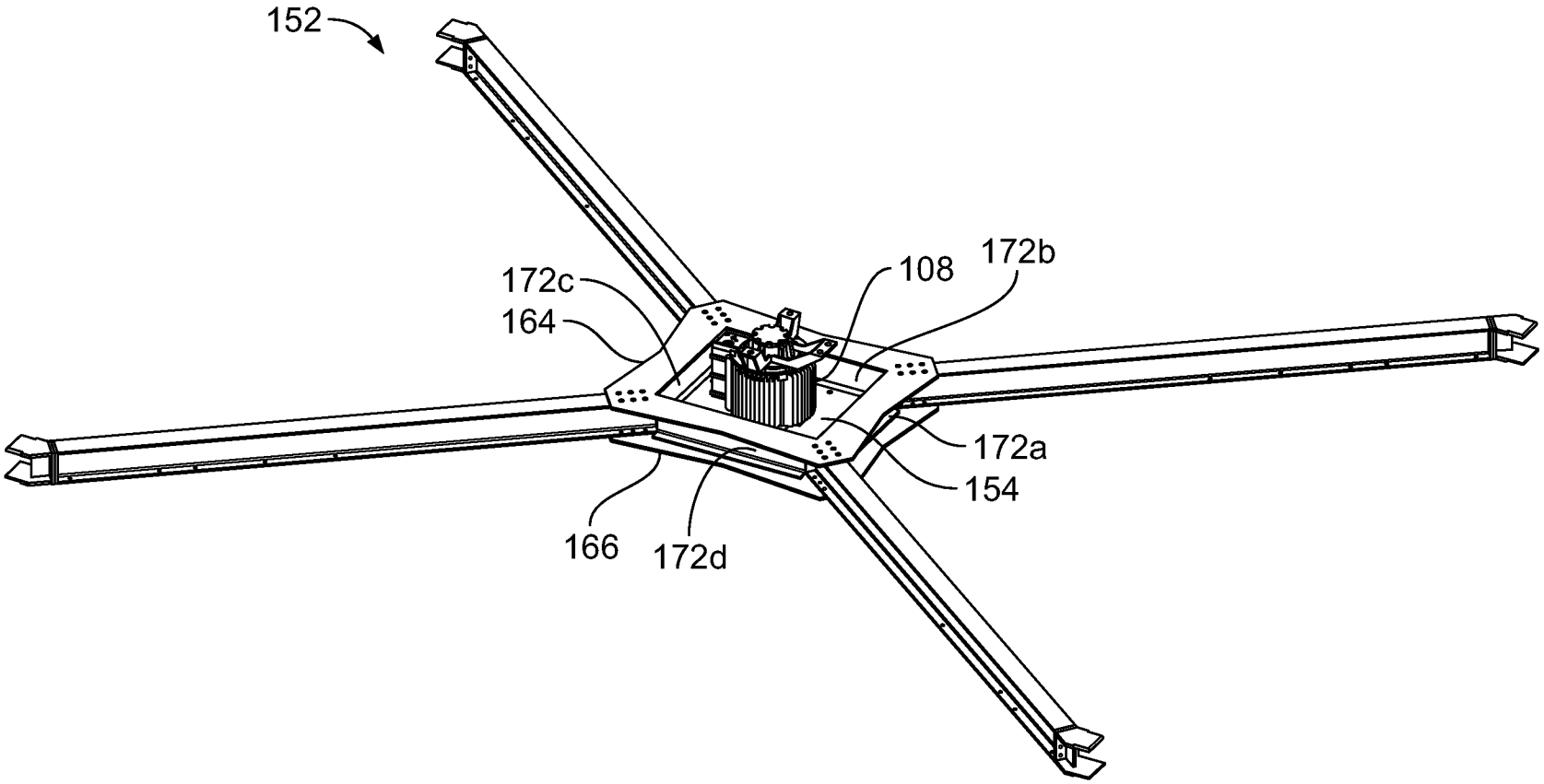
FIG. 13 is a perspective view of the X-brace assembly, motor mount and motor of FIG. 12 after assembly.

An alternative embodiment of the motor mount is presented in FIGS. 12 and 13. The X-brace assembly, indicated in general at 152 in FIGS. 12 and 13, has the same construction as the X-brace assembly 52 described above with reference to FIGS. 3-6. The motor mount of FIGS. 12 and 13, however, takes the form of a face mount plate 154.

As illustrated in FIG. 12, the face mount plate 154 includes a central opening 156 through which the drive shaft 122 of the electric fan motor 108 passes. The face mount plate 154 also includes fan mounting apertures 158 which receive fasteners (such as bolts) to secure the motor 108 to the face mount plate 154 in the position shown in FIG. 13. As illustrated in FIG. 12, the face mount plate 154 further includes peripheral apertures 162 that align with corresponding apertures 163 formed in the second central plate 166, when the face mount plate is in the position illustrated in FIG. 13, so that fasteners (such as screws 168 of FIG. 12) may be used to secure the face mount plate to the lower central plate. Of course, fasteners other than screws 168 and/or welding may be used to secure the face mount plate 154 to the second central plate 166.

As illustrated in FIG. 13, central side panels 172*a*-172*d* may be secured between the first central plate 164 and the second central plate 166, such as by fasteners or welding.

Use of the face mount plate 154 of FIGS. 12 and 13 to mount the motor 108 within the X-brace assembly 152 allows for enhanced airflow over the motor for cooling of the motor.

In an alternative embodiment, where the air-cooled heat exchanger with X-brace drive of the disclosure is an induced draft heat exchanger, the tube bundle(s) are located on the suction side of the fan (with the fan positioned above the bundle). More specifically, in such an embodiment, the support columns extend downwards from the tube bundle (which is now on the bottom of the heat exchanger). Furthermore, the plenum would be positioned above the tube bundle with the fan ring extending upwards from the top surface of the ceiling of the plenum with the fan ring opening being a top opening surrounded and defined by the top edge of the fan ring. The X-brace assembly and fan motor would be positioned below the tube bundle, with the drive shaft extending up through the tube bundle layer and plenum to the fan positioned in the fan ring. As a result, the motor is kept cool in the cold air stream.

Embodiments of the forced draft heat exchanger with X-brace drive described above tie in the vertical support columns for the unit to the fan drive system. This makes the structure of the heat exchanger entirely tied together, which benefits strength and rigidity while also providing reduced weight by eliminating components that are otherwise required. By housing the fan drive inside the plenum of the heat exchanger, some embodiments were able to achieve a 20% reduction in structure weight and a 45% reduction in drive weight compared to prior art heat exchangers with similar cooling capacity.

While the preferred embodiments of the invention have been shown and described, it will be apparent to those skilled in the art that changes and modifications may be made therein without departing from the spirit of the invention.

What is claimed is:

1. An air-cooled heat exchanger comprising:

a. a plenum;

b. a fan ring positioned adjacent to the plenum and having a fan ring opening;

c. a plurality of support columns configured to support the plenum and the fan ring on a support surface;

d. an X-brace assembly including a motor mount and a plurality of leg members extending radially from the motor mount with each one of the plurality of leg members connected to a single corresponding one of the plurality of support columns so that the plurality of leg members extend between the motor mount and the plurality of support columns;

e. a motor mounted to the motor mount of the X-brace assembly, said motor including a drive shaft;

f. a fan having a plurality of fan blades with each of the plurality of fan blades mounted to the drive shaft of the motor so that the fan blades radially extend from the drive shaft; and g. said fan positioned within the fan ring between the motor and the fan ring opening; h. wherein each of the plurality of leg members includes a proximal end and a distal end, and the X-brace assembly includes a first central plate and a second central plate with the proximal ends of each of the plurality of leg members positioned and secured between the first and second central plates.

2. The air-cooled heat exchanger of claim 1 wherein the motor is positioned within the plenum.

3. The air-cooled heat exchanger of claim 1 wherein the plenum includes a plenum floor having a central opening formed therein with the fan ring circumferentially secured along or about the central opening.

4. The air-cooled heat exchanger of claim 1 wherein the motor mount is secured to the second central plate.

5. The air-cooled heat exchanger of claim 4 wherein the motor mount includes a face mount plate having an opening through which the drive shaft extends.

6. The air-cooled heat exchanger of claim 4 wherein the motor mount includes a motor mount housing having a plurality of motor mount side panels connected to a motor mount plate with an open bottom opposing the motor mount plate and wherein the motor is mounted to the motor mount plate so as to be positioned within the motor mount housing and the second central plate includes an opening through which the drive shaft extends.

7. The air-cooled heat exchanger of claim 6 wherein each of the plurality of leg members includes an I-beam.

8. The air-cooled heat exchanger of claim 1 wherein each of the plurality of leg members includes a proximal end connected to the motor mount and a distal end with each distal end provided with a mounting bracket connected to a corresponding one of the plurality of support columns, each mounting bracket including:

i) a bracket mounting plate ii) a central support plate oriented perpendicular to and attached to the bracket mounting plate;

iii) an upper bracket plate and a lower bracket plate mounted to the bracket mounting plate and the central support plate with the upper bracket and lower bracket plates in a parallel orientation with the upper and lower bracket plates perpendicular to both the bracket mounting plate and the central support plate with the central support plate sandwiched between the upper and lower bracket plates.

9. The air-cooled heat exchanger of claim 8 wherein each of the plurality of support columns includes an I-beam.

10. The air-cooled heat exchanger of claim 1 wherein the plurality of support columns includes four support columns and the plurality of leg members includes four leg members.

11. The air-cooled heat exchanger of claim 1 further comprising a tube bundle supported by the plurality of support columns with the plenum positioned between the tube bundle and the fan ring.

12. The air-cooled heat exchanger of claim 1 wherein the air-cooled heat exchanger is configured as a forced draft air-cooled heat exchanger.

13. The air-cooled heat exchanger of claim 1 wherein the air-cooled heat exchanger is configured as an induced draft air-cooled heat exchanger.

14. An X-brace assembly for mounting a fan motor to an air-cooled heat exchanger supported by a plurality of support columns comprising:

a. a motor mount configured to attach to and support the fan motor;

b. a plurality of leg members extending radially from the motor mount with each one of the plurality of leg members configured to be connected to a single corresponding one of the plurality of support columns so that the plurality of leg members extend between the motor mount and the plurality of support columns; c. wherein each of the plurality of leg members includes a proximal end and a distal end, and the X-brace assembly includes a first central plate and a second central plate with the proximal ends of each of the plurality of leg members positioned and secured between the first and second central plates.

15. The X-brace assembly of claim 12 wherein each of the plurality of leg members includes a proximal end and a distal end and the X-brace assembly includes a first central plate and a second central plate with the proximal ends of each of the plurality of leg members positioned and secured therebetween, and wherein the motor mount is secured to the second central plate.

16. The X-brace assembly of claim 13 wherein the motor mount includes a face mount plate having an opening through which the drive shaft extends.

17. The X-brace assembly of claim 13 wherein the motor mount includes a motor mount housing having a plurality of motor mount side panels connected to a motor mount plate with an open bottom opposing the motor mount plate and wherein the motor mount plate is configured to attach to and support the fan motor so that the fan motor is positioned within the motor mount housing and the lower central plate includes an opening configured to that a drive shaft extends therethrough when the motor is mounted within the motor mount housing.

18. The X-brace assembly of claim 12 wherein each of the plurality of leg members includes an I-beam.

19. The X-brace assembly of claim 12 wherein each of the plurality of leg members includes a proximal end connected to the motor mount and a distal end with each distal end provided with a mounting bracket configured to connect to a corresponding one of the plurality of support columns, each mounting bracket including:

i) a bracket mounting plate ii) a central support plate oriented perpendicular to and attached to the bracket mounting plate;

iii) an upper bracket plate and a lower bracket plate mounted to the bracket mounting plate and the central support plate with the upper bracket and lower bracket plates in a parallel orientation with the upper and lower bracket plates perpendicular to both the bracket mounting plate and the central support plate with the central support plate sandwiched between the upper and lower bracket plates.

20. The X-brace assembly of claim 12 wherein the plurality of leg members includes four leg members.

* * * * *